United States Patent [19]

Petrovich

[11] 3,976,565

[45] Aug. 24, 1976

[54] FROTH FLOTATION METHOD FOR THE RECOVERY OF MINERALS BY MEANS OF QUATERNARY AMMONIUM NITRITES AND TERNARY PHOSPHINE DINITRITES

[76] Inventor: Vojislav Petrovich, 1925 W. Schiller St., Chicago, Ill. 60622

[22] Filed: June 2, 1975

[21] Appl. No.: 583,060

[52] U.S. Cl. ..... 209/166

[51] Int. Cl.[2] ..... B03C 1/02

[58] Field of Search ..... 209/166, 167

[56] References Cited

UNITED STATES PATENTS

| | | | |
|---|---|---|---|
| 1,552,936 | 9/1925 | McArthur | 209/167 |
| 2,084,413 | 6/1937 | Siens | 209/166 |
| 2,132,902 | 10/1938 | Lerher | 209/166 |
| 2,242,224 | 5/1941 | Bley | 209/166 X |
| 2,403,640 | 7/1946 | Cunningham | 209/167 |
| 2,861,687 | 11/1958 | Lord | 209/167 |
| 2,904,177 | 9/1959 | Michal | 209/167 |
| 2,970,688 | 2/1961 | Uhland | 209/166 |
| 3,238,127 | 3/1966 | Sebba | 209/166 X |

*Primary Examiner*—Robert Halper

[57] ABSTRACT

A froth flotation method for the recovery of copper, nickel, cobalt, oxide, silicate, sulfide, arsenide, and antimonide minerals from their ores over iron sulfides, silica and silicates, as well as for the recovery of silicate minerals of lithium, sodium, potassium, and caesium over silica and feromagnesian silicates, and for the recovery of potassium halides and sulfates, strontium, and barium sulfates and carbonates, which comprises; subjecting the comminuted ore of aforesaid metals and minerals to froth flotation process in the presence of nitrous acid and an effective amount of a combination of quaternary ammonium nitrite and ternary phosphine dinitrite, or a combination of aforesaid quaternary ammonium nitrite or ternary phosphine dinitrite, and potassium, sodium, or ammonium nitrite, calcium, strontium, barium, or iron dinitrite; the indicated compounds provide selectivity and recovery of aforesaid metal and mineral value.

1 Claim, No Drawings

FROTH FLOTATION METHOD FOR THE RECOVERY OF MINERALS BY MEANS OF QUATERNARY AMMONIUM NITRITES AND TERNARY PHOSPHINE DINITRITES

This invention relates to a new class of complexes of Werner's type in which unipositive and dipositive metals in their nitrite and dinitrite salts are replaced by their organic equivalents, the unipositive quaternary ammonium radical, and the dipositive ternary phosphine radical. Both radicals form in combination with nitrous acid and metals at the mineral surface of hereinafter said minerals undissociable complexes of triple nitrite type with frothing properties. The triple nitrites of this invention comprise the alkylhydroxyalkyl ammonium, and alkylhydroxyalkyl phosphine radicals. The aforesaid radicals always represent two metals in the respective nitrite complexes wherein each of the two metals is a member of a different group of metals. For example one group of metals for which the aforesaid radicals would be substituted are the alkali metals, whereas another group would be the alkaline earth metals, and some weak dipositive cations such as $NI^{++}$, $Co^{++}$, $Fe^{++}$, $Cu^{++}$, $Pb^{++}$. Thus the combination of aforesaid radicals and metals at the mineral surface yielding triple nitrite complexes, being so, the third metal in said triple nitrite complexes is the metal at the mineral surface.

Besides triple nitrite complexes which are the most stable and normal in such nitrites, the only stable double nitrite is formed of potassium and cobalt which is very stable. Despite of this fact the weight of the invention is put on the triple nitrite complexes. Many double nitrite salts exist but they are not stable, or not sufficient stable to serve in froth flotation practice. Thus, the stable double nitrite being feasible only with potassium and cobalt minerals, so either potassium cation which is fixed at the mineral surface combines with ternary phosphine radical representing organic equivalent of cobalt cation, or cobalt cation which is fixed at the mineral surface combines with quaternary ammonium radical representing organic equivalent of potassium cation by means of nitrous acid radical as complexing anion.

The complexing ability of nitrite as acid radical of a very weak acid with the aforesaid metals in respective minerals depends upon the pressure of coordinated alkali metals, or earth alkaline metals, which in the respective case of this invention the alkali metals are represented by quaternary ammonium unipositive cations, and the earth alkaline metals are represented by ternary phosphine dipositive cations. Thus, quaternary ammonium radical with the shortest chain length of substituted hydrocarbons, which exercises a strong alkaline reaction, may unite with nitrous radical to form stable non hydrolizable nitrites. Analogously, the ternary phosphine radical which exercises a less strong alkaline reaction, may unite with nitrous radicals to form stable non hydrolizable dinitrites. Both, quaternary ammonium nitrites and ternary phosphine dinitrites readily combine with aforesaid metals at the mineral surface and nitrous acid to undissociable mineral-hydrocarbon complexes of triple nitrite type.

In triple nitrite complexes of aforesaid metals, the nature of complexing cations may be such that two different quaternary ammonium unipositive radicals yield stable undissociable complexes at the mineral surface as is the case in flotation of cobalt minerals in a combination of triethylethanolammonium nitrite and tripropylpropanolammonium nitrite, which represent organic equivalents of potassium and sodium cations. In case of applying ternary phosphine dipositive radicals the nature of complexing cations may be such that two different ternary phosphine dipositive radicals yield stable undissociable complexes at the mineral surface as is the case in flotation of potassium silicates which is accomplished in a combination of triethylphosphine dinitrite and dihexanolhexylphosphine dinitrite representing organic equivalents of barium and nickel cations respectively. In most cases as the experience teaches the practicing of recovering of aforesaid metals and minerals from their ores by froth flotation process and the most satisfactory in many cases and the only way to recover certain minerals is by applying a combination of quaternary ammonium radical and ternary phosphine radical.

In accordance with the invention one unipositive cation nitrate be potassium, sodium, or ammonia, and one dipositive cation may be calcium, strontium, barium, copper, lead, nickel, or iron, in such cases only one organic cation is sufficient, i.e., either ammonium unipositive cation or phosphine dipositive cation. Such practicing is satisfactory and cheaper, which is an appealing advantage. Potassium, sodium, ammonium, calcium, strontium, and barium cations are added to the mineral slurry as nitrites, copper, nickel, and iron cations are added to the mineral slurry as sulfate with the addition of barium nitrite, lead cation is added as acetate or nitrite with the addition of nitrous acid.

Because in triple nitrites three metals form the complex, which represent three groups of very alike cations, many substitutions are possible. Namely, in triple nitrite of the composition $$K_2PbCu(NO_2)_6$$

each of the involved metal may be replaced 1. copper by metals: iron, nickel and cobalt;
2. lead by metals: calcium strontium, and barium;
3. potassium by metals: rubidium, and caesium, and ammonia;

Lead-di(-dipropylpropanolphosphine-trimethylethylammonium)hexanitrite

Copper-di(-hexyldihexanolphosphine-dimethyldiethylammonium)hexanitrite

Nickel-di(-dipropylbutanolphosphine-tetraethylammonium)hexanitrite

Cobalt-di(-dipropylpropanolammonium-dimethyldiethylammonium)hexanitrite

Lithium-di(-octyldioctanolphosphine-dimethyldiethylammonium)hexanitrite

Sodium-di(dioctyloctanolphosphine-tetramethylammonium)hexanitrite

Potassium-di(-tripropylphosphine-dihexylhexanolphosphine)hexanitrite

Strontium-di(-dihexylhexanolphosphine-tetraethylammonium)hexanitrite

Barium-di(-dihexylhexanolphosphine-tetramethylammonium)hexanitrite

The variations of the number of hydroxyl groups in said quaternary and ternary compounds as well as in complexes is based on the differences of alkalinity as well as because of different lengths of alkyl chains in the same. Thus, high alkaline and short chain quaternary ammonium or ternary phosphine radicals preferably have not any hydroxyl, while the longer chained and less alkaline have one, two or three hydroxyls, for, minimum one hydroxyl in each complex must be present.

These replacements do not change, or change very little the stability of the complexes.

Thus, this invention relates to a new froth flotation method for the recovery of minerals containing lithium, sodium, potassium, caesium, strontium, barium, copper, nickel, and cobalt with a combination of nitrous acid, quaternary ammonium nitrites and ternary phosphine dinitrites, or a combination of either ammonium nitrite and one of aforesaid metal cations, or phosphine dinitirte and one of aforesaid metal cations.

Quaternary ammonium nitrites and ternary phosphine dinitrites are particularly adapted for the use in highly selective froth flotation processes for recovering of oxide, silicate, sulfide, arsenide, and antimonide minerals of copper, nickel, and cobalt. The method is well adapted to silicates of lithium, sodium, potassium, and caesium, such as feldspar minerals, and particularly for sodium feldspar albite, potassium feldspar orthoclase and microcline, and pollucite sodium-caesium feldspar, furthermore, potassium mica, lithium mica, as well as potassium halides and sulfates, and particularly for alunite aluminum hydrous potassium sulfate. Furthermore, for barium minerals such as barytes and witherite, and strontium minerals such as strontianite and celestine.

Complexes of double and triple nitrites with quaternary ammonium unipositive cations and ternary phosphine dipositive cations yield polarly oriented non-hydrolizable and undissociable complexes capable of forming bubbles or attaching to the bubbles of the froth provided by agitation of the pulp of mineral slurry. The said quaternary ammonium and ternary phosphine radicals of this invention possess collecting as well as some frothing properties which simplify the froth flotation process, which is obviously an advantage.

THE PREFERRED EMBODIMENTS

The preferred embodiments of collectors are of the following generic formula:

for quaternary ammonium series for ternary phosphine series

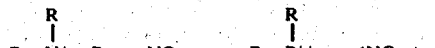

wherein R may be of the same constitution or to be of different constitution. Thus, R may be alkyl, alkanol, or polyhydroxyalkyl such as alkyldiol or alkyltriol, said alkyl compounds have from 1 to 8 carbon atoms, and 0 to 3 hydroxyl groups. Said quaternary ammonium radicals comprise: monoalkyltrialkanol-, dialkyldialkanol-, trialkylmonoalkanol-, tetraalkyl-ammonium nitrite, said ternary phosphine radicals comprise: trialkanol-, monoalkyldialkanol-, dialkylmonoalkanol-, trialkylphosphine dinitrite. The number of hydroxyl groups for the entire complex is from 1 to 3. The aforesaid radicals, i.e., ammonium radical represents alkali metals and ammonia, whereas phosphine radical represents earth alkaline metals, and the group of weak basic dipositive cations such as $Ni^{++}$, $Co^{++}$, $Fe^{++}$, $Cu^{++}$, $Pb^{++}$.

The preferred embodiments of this invention representing alkali metals are:

mono-, di-, tri-, or tetra- pentanol-pentyl-ammonium cation mono-, di-, tri-, or tetra- butanol-butyl-ammonium cation mono-, di-, tri-, or tetra- propanol-propyl-ammonium cation mono-, di-, tri-, or tetra- ethanol-ethyl-ammonium cation mono-, di-, tri-, or tetra- methanol-methyl-ammonium cation The preferred embodiments of this invention representing earth alkaline metals are:

mono-, di-, or tri- butanol-butyl-phosphine cation mono-, di-, or tri- propanol-propyl-phosphine cation mono-, di-, or tri- ethanol-ethyl-phosphine cation mono-, di-, or tri- methanol-methyl-phosphine cation The preferred embodiments of this invention representing metal dipositive cations such as $Ni^{++}$, $Co^{++}$, $Fe^{++}$, $Cu^{++}$, $Pb^{++}$, are:

mono-, di-, or tri- octanol-octyl-phosphine cation mono-, di-, or tri- heptanol-heptyl-phosphine cation mono-, di-, or tri- hexanol-hexyl-phosphine cation mono-, di-, or tri- pentanol-pentyl-phosphine cation In accordance with the invention one unipositive cation may be potassium, sodium, or ammonia, and one dipositive cation may be calcium, strontium, barium, copper, lead, nickel and iron. In such cases all of possible and useful combinations yield equally satisfactory results in recovering of aforesaid minerals from their ores.

SUMMARY OF THE INVENTION

The principal objective of this invention is to provide a new method of froth flotation practice.

A further objective of this invention is to provide froth flotation agents with collecting and frothing properties for collecting copper, nickel, and cobalt, oxide, silicate, sulfide, arsenide, and antimonide minerals from their ores, furthermore, aluminosilicates of lithium, sodium, potassium, and caesium, potassium halides and sulfates minerals, strontium, and barium carbonates and sulfates from their ores. In accordance with said objective and to the best of this applicant's knowledge the said objective have not been accomplished in the past. Furthermore, the applicant has discovered that most gangue minerals are unaffected by collectors of this invention. Hence a method for obtaining a highly selective concentration of metal or mineral values of aforesaid minerals from their ores in froth concentrates is provided.

The forth flotation of aforesaid minerals from their ores by serving with the present invention is carried out in accordance with good flotation practice and usually, though not always, involves flotation in rougher cells, followed by one or several cleanings of the rougher concentrate. The reagents are effective in small amount and the promotion is sufficiently persistent so that it is possible to carry out rougher and cleaner flotation with a single addition of the reagents at the beginning of the operation. On the other hand, it is sometimes advantageous to use stage addition of reagents. Pulp densities are in general the same as in other applications of froth flotation practice, i.e., about 15 to 30 percent of solids by weight.

The above discussion as well as the disclosure illustrates my invention in a broad and general way; for a detailed illustration thereof the examples of preferred embodiments are set forth below.

The procedure in performing laboratory examples was of the same manipulation as follows:

The flotation tests for the recovery of copper ores.

The flotation tests were accomplished with sized samples passing 120 mesh sieve, in a 50 grams flotation cell with 50 grams of a run of mine copper ore consisting of chalcopyrite and covelline and predominantly pyrite in Examples 1 and 2, and a run of mine copper ore consisting of chrysocolla and malachite in gangue material composed of iron oxide, some pyrite, quartz, and calcium carbonate in Example 3. The reagents were added dropwise. These flotation tests gave froth concentrates in which the recovery was estimated by microscopic count.

| Example | Collector used | Auxiliary agents | Copper Recovery percent |
|---|---|---|---|
| 1 | Trimethylmethanolammonium nitrite<br>Dipentylpentanolphosphine dinitrite | Nitrous acid | 95 |
| 2 | Dipentylpentanolphosphine dinitrite | Potassium nitrite<br>Nitrous acid | 92 |
| 3 | Trimethylmethanolammonium nitrite | $FeSO_4$, $Ba(NO_2)_2$<br>Nitrous acid | 90 |

The flotation tests for the recovery of nickel ores.

The flotation tests were accomplished with sized samples passing 120 mesh sieve, in a 50 grams flotation cell with 10 grams of a mixture of ullmannite and chloanthite, and 40 grams of a mixture of sulfide minerals such as pyrite and galena. The reagents were added dropwise. These flotation tests gave froth concentrates in which the recovery was estimated by microscopic count.

| Example | Collectors used | Auxiliary agents | Nickel Recovery percent |
|---|---|---|---|
| 4 | Triethylethanolammonium nitrite<br>Diethylethanolphosphine dinitrite | Nitrous acid | 91 |
| 5 | Triethylethanolammonium nitrite | Barium dinitrite<br>Nitrous acid | 89 |
| 6 | Diethylethanolphosphine dinitrite | Potassium nitrite<br>Nitrous acid | 86 |

The flotation tests for the recovery of cobalt minerals.

The flotation tests were accomplished with sized samples passing 120 mesh sieve in a 50 grams flotation cell with 10 grams of a mixture of cobaltite and smaltite, and 40 grams of a mixture of iron, lead, zinc, and copper sulfides. The reagents were added dropwise. These flotation tests gave concentrates in which the recovery was estimated by microscopic count.

| Example | Collectors used | Auxiliary agents | Cobalt Recovery percent |
|---|---|---|---|
| 7 | Triethylethanolammonium nitrite<br>Tripropylpropanolammonium nitrite | Nitrous acid | 89 |
| 8 | Triethylethanolammonium nitrite | Sodium nitrite<br>Nitrous acid | 86 |
| 9 | Tripropylpropanolammonium nitrite | Potassium nitrite<br>Nitrous acid | 88 |

The flotation tests for the recovery of lepidolite, lithium mica.

The flotation tests were accomplished with sized samples passing 100 mesh sieve, in a 50 grams flotation cell with 5 grams of lepidolite and 45 grams of microcline. The reagents were added dropwise. These flotation tests gave froth concentrates in which the recovery was estimated by microscopic count.

| Example | Collectors used | Auxiliary agents | Lepidolite Recovery percent |
|---|---|---|---|
| 10 | Triethylethanolammonium nitrite<br>Dioctyloctanolphosphine dinitrite | Nitrous acid | 94 |
| 11 | Triethylethanolammonium nitrite | $FeSO_4$, $Ba(NO_2)_2$<br>Nitrous acid | 90 |
| 12 | Dioctyloctanolphosphine dinitrite | Potassium nitrite<br>Nitrous acid | 92 |

The flotation tests for the recovery of albite, sodium feldspar.

The flotation tests were accomplished with sized samples passing 100 mesh sieve, in a 50 grams flotation cell with 25 grams of albite, and 25 grams of a mixture of quartz, mica, sericite, orthoclase and plagioclase. The reagents were added dropwise. These flotation tests gave concentrates in which the recovery was estimated by microscopic count.

| Example | Collectors used | Auxiliary agents | Albite Recovery percent |
|---|---|---|---|
| 13 | Trimethylmethanolammonium nitrite<br>Dioctyloctanolphosphine dinitrite | Nitrous acid | 95 |
| 14 | Trimethylmethanolammonium nitrite | $FeSO_4$, $Ba(NO_2)_2$<br>Nitrous acid | 93 |
| 15 | Dioctyloctanolphosphine dinitrite | Potassium nitrite<br>Nitrous acid | 93 |

The flotation tests for the recovery of orthoclase, potassium feldspar.

The flotation tests were accomplished with sized samples passing 100 mesh sieve, in a 50 grams flotation cell with 25 grams of orthoclase and 25 grams of a mixture of quartz, biotite, and plagioclase. The reagents were added dropwise. These flotation tests gave froth concentrates in which the recovery was estimated by microscopic count.

| Example | Collectors used | Auxiliary agents | Orthoclase Recovery percent |
|---|---|---|---|
| 16 | Dipropylpropanolphosphine dinitrite<br>Dihexylhexanolphosphine dinitrite | Nitrous acid | 95 |
| 17 | Dipropylpropanolphosphine dinitrite | $FeSO_4$, $Ba(NO_2)_2$<br>Nitrous acid | 93 |
| 18 | Dihexylhexanolphosphine dinitrite | Calcium dinitrite<br>Nitrous acid | 93 |

The flotation tests for the recovery of sylvine, potassium chloride.

The flotation tests were accomplished with sized samples passing 48 mesh sieve, in a 50 grams flotation cell with 25 grams of sylvine and 25 grams of sodium halide in a saturated brine. The reagents were added dropwise. These froth flotation tests gave froth concentrates in which the recovery was accomplished by chemical analysis.

| Example | Collectors used | Auxiliary agents | Sylvine Recovery percent |
|---|---|---|---|
| 19 | Tripropylpropanolammonium nitrite<br>Dioctyloctanolphosphine dinitrite | Nitrous acid | 90 |
| 20 | Tripropylpropanolammonium nitrite | $FeSO_4$, $Ba(NO_2)_2$<br>Nitrous acid | 86 |
| 21 | Dioctyloctanolphosphine dinitrite | Sodium nitrite<br>Nitrous acid | 87 |

The flotation tests for the recovery of pollucite, caesium-sodium feldspar.

The flotation tests were accomplished with sized samples passing 100 mesh sieve, in a 50 grams flotation cell with 5 grams of pollucite and 45 grams of orthoclass and microcline. The reagents were added dropwise. These flotation tests gave froth concentrates in which the recovery was estimated by microscopic count.

| Example | Collectors used | Auxiliary agents | Pollucite Recovery percent |
|---|---|---|---|
| 22 | Dipropylpropanolphosphine dinitrite<br>Dihexanolhexylphosphine dinitrite | Nitrous acid | 85 |
| 23 | Dipropylpropanolphosphine dinitrite | $FeSO_4$, $Ba(NO_2)_2$<br>Nitrous acid | 84 |
| 24 | Dihexanolhexylphosphine dinitrite | Barium dinitrite<br>Nitrous acid | 86 |

The flotation tests for the recovery of celectine, strontium sulfate.

The flotation tests were accomplished with sized samples passing 100 mesh sieve, in a 50 grams flotation cell with 50 grams of celectine ore mixed with carboniferous schist. The reagents were added dropwise. These flotation tests gave froth concentrates in which the recovery was estimated by microscopic count.

| Example | Collectors used | Auxiliary agents | Celestine Recovery percent |
|---|---|---|---|
| 25 | Trimethylmethanolammonium nitrite<br>Dihexylhexanolphosphine dinitrite | Nitrous acid | 93 |
| 26 | Trimethylmethanolammonium nitrite | $FeSO_4$, $Ba(NO_2)_2$<br>Nitrous acid | 90 |
| 27 | Dihexylhexanolphosphine dinitrite | Potassium nitrite<br>Nitrous acid | 91 |

The flotation tests for the recovery of barytes, barium sulfate.

The flotation tests were accomplished with sized samples passing 120 mesh sieve, in a 50 grams flotation cell with 50 grams barytes ore mixed with pyrite and schist. The reagents were added dropwise. These flotation tests gave froth concentrates in which the recovery was estimated by microscopic count.

| Example | Collectors used | Auxiliary agents | Barytes Recovery percent |
|---|---|---|---|
| 28 | Trimethylbutanolammonium nitrite<br>Dihexylhexanolphosphine dinitrite | Nitrous acid | 94 |
| 29 | Trimethylbutanolammonium nitrite | $FeSO_4$, $Ba(NO_2)_2$<br>Nitrous acid | 93 |
| 30 | Dihexylhexanolphosphine dinitrite | Potassium nitrite<br>Nitrous acid | 95 |

It is to be understood that the use of varying amounts of dispersants, depressants, frothers etc. in different stages may be used to advantage to obtain the highest yield and best separation.

I claim:

1. A method of beneficiating ores selected from the group consisting of oxide, silicate, sulfide, arsenide, and antimonide of copper, nickel, and cobalt, and minerals selected from the group consisting of lithium, sodium, potassium, and caesium silicates, halides and sulfates, barium and strontium sulfates and carbonates by a froth flotation process to produce a froth concentrate of desired metal or mineral value which comprises; effecting froth flotation of said ores and minerals in the presence of nitrous acid and collectors consisting of a combination of quaternary ammonium nitrite and ternary phosphine dinitrite, or a combination of two different quaternary ammonium nitrites, or a combination of quaternary ammonium nitrite and either sodium, potassium, and ammonia nitrites, or calcium, strontium, barium, and iron dinitrites, said collectors in conjunction with nitrous acid forming at the mineral surface of said metals mineral hydrocarbon undissociable complexes, both components of said complexes having the formula:

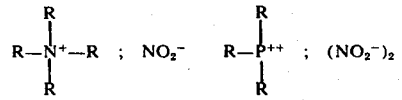

in which R may be of the same constitution or to be of different constitution, R is selected from the group consisting of alkyl alkanol, alkyldiol or alkyltriol, said R,s containing from 1–8 carbon atoms, the number of hydroxyl groups furnished by the combinations of said collectors, being 0 to 3 the number of said hydroxyl groups in said mineral hydrocarbon complexes being 1 to 3, the shorter chain R's of said quaternary ammonium nitrites and ternary phosphine dinitrites having zero hydroxyls, the larger chain R's of the quaternary ammonium nitrites and ternary phosphine dinitrites having 1–3 hydroxyl groups said complexes attaching to the bubbles provided by agitating the pulp of mineral slurry and recovering a froth concentrate relatively rich in the desired metal or mineral value, leaving tailing relatively poor in the desired metal or mineral value.

* * * * *